US010544495B2

(12) United States Patent
Yano et al.

(10) Patent No.: US 10,544,495 B2
(45) Date of Patent: Jan. 28, 2020

(54) CASTING MOLD MATERIAL AND CU—CR—ZR ALLOY MATERIAL

(71) Applicant: MITSUBISHI MATERIALS CORPORATION, Tokyo (JP)

(72) Inventors: Shoichiro Yano, Iwaki (JP); Toshio Sakamoto, Kitamoto (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 243 days.

(21) Appl. No.: 15/500,806

(22) PCT Filed: Sep. 14, 2015

(86) PCT No.: PCT/JP2015/075996

§ 371 (c)(1),
(2) Date: Jan. 31, 2017

(87) PCT Pub. No.: WO2016/047484

PCT Pub. Date: Mar. 31, 2016

(65) Prior Publication Data

US 2017/0292181 A1 Oct. 12, 2017

(30) Foreign Application Priority Data

Sep. 25, 2014 (JP) ..... 2014-195023
Aug. 28, 2015 (JP) ..... 2015-169825

(51) Int. Cl.
*C22F 1/08* (2006.01)
*B22D 11/059* (2006.01)
*C22C 9/00* (2006.01)

(52) U.S. Cl.
CPC ..... *C22F 1/08* (2013.01); *B22D 11/059* (2013.01); *C22C 9/00* (2013.01)

(58) Field of Classification Search
CPC ..... B22C 9/061; B22D 11/059; C22C 9/00; C22F 1/08
See application file for complete search history.

(56) References Cited

U.S. PATENT DOCUMENTS 4,589,930 A * 5/1986 Kumagai ..... C22C 9/00 148/411
5,798,008 A 8/1998 Nogami et al.
(Continued)

FOREIGN PATENT DOCUMENTS

JP 55-128350 A 10/1980
JP 59-193233 A 11/1984
(Continued)

OTHER PUBLICATIONS

Extended European Search Report dated Feb. 1, 2018 for the corresponding European Patent Application No. 15843300.3.
(Continued)

*Primary Examiner* — Veronica F Faison
(74) *Attorney, Agent, or Firm* — Leason Ellis LLP

(57) ABSTRACT

A casting mold material of the present invention includes, as a composition: 0.3 mass % to less than 0.5 mass % of Cr, 0.01 mass % to 0.15 mass % of Zr, and a balance consisting of Cu and inevitable impurities, and the casting mold material has acicular precipitates or plate-like precipitates containing Cr.

5 Claims, 5 Drawing Sheets

(56) References Cited

U.S. PATENT DOCUMENTS

2003/0155051 A1* 8/2003 Mino ..... C22C 9/00 148/554
2006/0088437 A1* 4/2006 Nippert ..... C22C 9/00 420/492
2006/0180293 A1* 8/2006 Maehara ..... B22D 11/004 164/459
2010/0319818 A1* 12/2010 Sawai ..... C22C 9/00 148/554
2011/0100676 A1* 5/2011 Oishi ..... C22C 9/02 174/126.1
2011/0244260 A1* 10/2011 Kuwagaki ..... C22C 9/06 428/546
2013/0000792 A1* 1/2013 Takeda ..... C22F 1/00 148/511
2013/0167988 A1* 7/2013 Sakurai ..... C22C 9/06 148/682
2015/0376755 A1* 12/2015 Kim ..... C22F 1/08 148/554
2017/0283910 A1* 10/2017 Tsuru ..... C25D 5/10
2018/0291490 A1* 10/2018 Yano ..... C22C 9/00
2018/0297109 A1* 10/2018 Yano ..... B22C 9/06

FOREIGN PATENT DOCUMENTS

JP 04-028837 A 1/1992
JP 05-070867 A 3/1993
JP 05-339688 A 12/1993
JP 09-087815 A 3/1997
JP 2002-180158 A 6/2002

OTHER PUBLICATIONS

International Search Report dated Dec. 15, 2015 for the corresponding PCT Application No. PCT/JP2015/075996.

* cited by examiner

CASTING MOLD MATERIAL AND CU—CR—ZR ALLOY MATERIAL

CROSS-REFERENCE TO RELATED PATENT APPLICATIONS

This application is a U.S. National Phase application under 35 U.S.C. § 371 of International Patent Application No. PCT/JP2015/075996, filed Sep. 14, 2015, and claims the benefit of Japanese Patent Applications No. 2014-195023, Sep. 25, 2014 and No. 2015-169825, filed Aug. 28, 2015, all of which are incorporated by reference herein in their entireties. The International application was published in Japanese on Mar. 31, 2016 as International Publication No. WO/2016/047484 under PCT Article 21(2).

FIELD OF THE INVENTION

The present invention relates to a casting mold material used for casting metal such as steel materials and a Cu—Cr—Zr alloy material suitable for the casting mold material.

BACKGROUND OF THE INVENTION

In the related art, for casting mold materials used for casting steel materials and the like, there is a demand for excellent characteristics such as high-temperature strength enabling the casting mold materials to withstand strong thermal stress, high-temperature elongation enabling the casting mold materials to withstand severe thermal fatigue environments, and wear resistance (hardness) at a high temperature. Therefore, Cu—Cr—Zr-based alloys being favorable in terms of the above-described characteristics are used as continuous casting mold materials. For example, Japanese Unexamined Patent Application, First Publication No. H05-339688 discloses a casting mold material containing 0.3% to 1.2% of Cr, 0.05% to 0.25% of Zr, and a balance consisting of Cu and impurities.

In addition, it is known that, in Cu—Cr—Zr alloys, the above-described characteristics are improved by further adding additive elements, and, for example, Japanese Unexamined Patent Application, First Publication No. H04-028837 discloses a casting mold material containing, in addition to Cr and Zr, 0.005% to 0.7% of Ti and 0.003% to 0.1% of Si and further containing 0.005% to 1.5% of one or more of Fe, Ni, and Co and a balance consisting of Cu and impurities.

In the Cu—Cr—Zr-based alloys described in Japanese Unexamined Patent Application, First Publication No. H05-339688 and Japanese Unexamined Patent Application, First Publication No. H04-028837, when a supersaturated solid solution of Cr and Zr which turns into a non-equilibrium phase by a solution treatment is formed, and Cr and Zr are dispersed and precipitated by the subsequent aging treatment, mechanical characteristics such as high-temperature strength, high-temperature elongation, and the wear resistance (hardness), the electrical conductivity, and the thermal conductivity are improved. In order to form the above-described supersaturated solid solution, it is necessary to carry out rapid cooling after the solution treatment.

Technical Problem

Generally, casting mold materials are used after the durability is improved by thermal-spraying a Ni—Cr alloy or the like having excellent thermal resistance and wear resistance on the surface thereof. When the above-described thermal spraying treatment is carried out, since the casting mold materials are slowly cooled instead of water cooling or the like after a thermal treatment is carried out in a high temperature range of, for example, approximately 1,000° C., there has been a problem in that strength (hardness) or electrical conductivity does not sufficiently improve even when an aging treatment is carried out after the thermal spraying treatment.

In detail, in a case where the casting mold materials are slowly cooled to, for example, 800° C. at a cooling rate of 25° C./min or lower after a thermal treatment is carried out in a high temperature range of approximately 1,000° C., granular Cr-containing precipitates (Cr-based precipitates) and granular Zr-containing precipitates (Zr-based precipitates) are precipitated during the slow cooling. In addition, in the subsequent aging treatment, Cr and Zr which have formed solid solutions around these granular precipitates as nuclei are precipitated, and thus the precipitates grow and coarsen, it becomes impossible to sufficiently ensure fine precipitates which contribute to the precipitation strengthening mechanism, and it becomes impossible to improve strength (hardness).

This invention has been made in consideration of the above-described circumstances, and an object of the present invention is to provide: a casting mold material in which even in a case where the casting mold material is slowly cooled after a thermal spraying treatment, strength (hardness) and electrical conductivity can be sufficiently improved by means of the subsequent aging treatment; and a Cu—Cr—Zr alloy material suitable for this casting mold material.

SUMMARY OF INVENTION

Solution to Problem

In order to achieve the above-described object, a casting mold material according to a first aspect of the present invention which is used for casting a metal material, includes, as a composition: 0.3 mass % to less than 0.5 mass % of Cr; 0.01 mass % to 0.15 mass % of Zr; and a balance consisting of Cu and inevitable impurities, and has acicular precipitates or plate-like precipitates containing Cr.

In the casting mold material having this constitution, since the composition thereof includes 0.3 mass % to less than 0.5 mass % of Cr, 0.01 mass % to 0.15 mass % of Zr, and a balance consisting of Cu and inevitable impurities, it is possible to improve strength (hardness) and electrical conductivity by precipitating fine precipitates by means of an aging treatment.

In addition, since the casting mold material has acicular precipitates or plate-like precipitates containing Cr, granular precipitates being formed during slow cooling after a thermal spraying treatment are suppressed. Therefore, in the aging treatment after the thermal spraying treatment, Cr and Zr being precipitated around granular precipitates as nuclei are suppressed, it is possible to sufficiently disperse fine precipitates, and it is possible to sufficiently improve strength (hardness) and electrical conductivity by means of the precipitation strengthening mechanism.

Here, the casting mold material according to the first aspect of the present invention preferably further includes a total of 0.01 mass % to 0.15 mass % of one or more elements selected from Fe, Si, Co, and P.

In this case, since the casting mold material includes elements of Fe, Si, Co, and P in the above-described range, granular precipitates being formed during slow cooling after the thermal spraying treatment are suppressed, and the generation of acicular precipitates or plate-like precipitates containing Cr is accelerated. Therefore, it is possible to sufficiently precipitate fine Cr-based and Zr-based precipitates by means of the aging treatment after the thermal spraying treatment, and it is possible to reliably improve strength (hardness) and electrical conductivity.

A Cu—Cr—Zr alloy material according to a second aspect of the present invention includes, as a composition: 0.3 mass % to less than 0.5 mass % of Cr; 0.01 mass % to 0.15 mass % of Zr; and a balance consisting of Cu and inevitable impurities, in which, in a case where the Cu—Cr—Zr alloy material is maintained at 800° C. after a full solution treatment, a maintenance time taken for electrical conductivity to reach 55% IACS is 25 seconds or longer.

In the Cu—Cr—Zr alloy material having this constitution, in a case where the Cu—Cr—Zr alloy material is maintained at 800° C. after a full solution treatment, since the maintenance time taken for the electrical conductivity to reach 55% IACS is set to 25 seconds or longer, even in a case where the Cu—Cr—Zr alloy material is heated to a high temperature range of, for example, approximately 1,000° C. and then is slowly cooled, it is possible to suppress unnecessary precipitation of Cr and Zr and thus ensure the amount of the solid solution of Cr and Zr.

Therefore, even in a case where the aging treatment is carried out after the slow cooling, it is possible to disperse the fine Cr-based and Zr-based precipitates, and it is possible to improve strength (hardness) and electrical conductivity.

Here, the Cu—Cr—Zr alloy material according to the second aspect of the present invention preferably further includes a total of 0.01 mass % to 0.15 mass % of one or more elements selected from Fe, Si, Co, and P.

In this case, since the Cu—Cr—Zr alloy material includes elements of Fe, Si, Co, and P in the above-described range, even in a case where the Cu—Cr—Zr alloy material is heated to a high temperature range of, for example, approximately 1,000° C. and then is slowly cooled, it is possible to suppress unnecessary precipitation of Cr and Zr and thus ensure the amount of the solid solution of Cr and Zr. Therefore, it is possible to sufficiently precipitate fine precipitates by means of the aging treatment after the slow cooling, and it is possible to reliably improve strength (hardness) and electrical conductivity.

In addition, the Cu—Cr—Zr alloy material according to the second aspect of the present invention preferably has a relationship of B/A>1.1 in a case where electrical conductivity (% IACS) after the Cu—Cr—Zr alloy material is maintained at 1,000° C. for one hour and then is cooled from 1,000° C. to 600° C. at a cooling rate of 10° C./min is represented by A, and electrical conductivity (% IACS) after the Cu—Cr—Zr alloy material is further maintained at 500° C. for three hours is represented by B.

In this case, even in a case where the Cu—Cr—Zr alloy material is slowly cooled from 1,000° C. to 600° C. at a cooling rate of 10° C./min, the electrical conductivity is improved by the subsequent thermal treatment at 500° C. for three hours, and it becomes possible to improve the strength by means of precipitation hardening. Therefore, the Cu—Cr—Zr alloy material is particularly suitable as a material for the above-described casting mold material.

Advantageous Effects of Invention

According to the present invention, it is possible to provide: a casting mold material in which even in a case where the casting mold material is slowly cooled after a thermal spraying treatment, strength (hardness) and electrical conductivity can be sufficiently improved by means of the subsequent aging treatment; and a Cu—Cr—Zr alloy material suitable for this casting mold material.

BRIEF DESCRIPTION OF THE DRAWINGS

FIG. 3(*a*) is a structural observation photograph after a first aging treatment, FIG. 3(*b*) is a structural observation photograph after a thermal spraying treatment and slow cooling, and FIG. 3(*c*) is a structural observation photograph after a second aging treatment.

FIG. 4(*a*) is a structural observation photograph, FIG. 4(*b*) is an enlarged view of a portion surrounded by a white line in FIG. 4(*a*), FIG. 4(*c*) is an element mapping result of Zr in FIG. 4(*b*), and FIG. 4(*d*) is an element mapping result of Cr in FIG. 4(*b*).

DETAILED DESCRIPTION OF THE INVENTION

Figure 1:
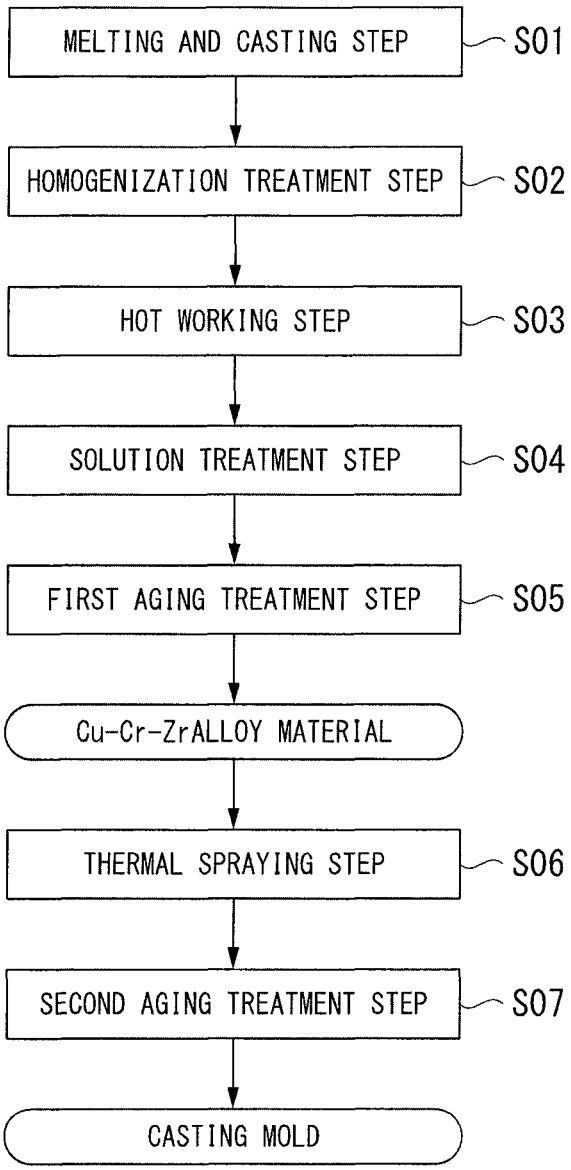
FIG. 1 is a flowchart of a method for manufacturing a casting mold material that is an embodiment of the present invention.

Hereinafter, a casting mold material and a Cu—Cr—Zr alloy material which are an embodiment of the present invention will be described.

The casting mold material of the present embodiment is used as a continuous casting die for continuously casting steel materials and the like. In addition, in the present embodiment, the Cu—Cr—Zr alloy material is used as a material for the casting mold material.

The casting mold material and the Cu—Cr—Zr alloy material of the present embodiment have a composition including 0.3 mass % to less than 0.5 mass % of Cr, 0.01 mass % to 0.15 mass % of Zr, and a balance consisting of Cu and inevitable impurities, and further including a total of 0.01 mass % to 0.15 mass % of one or more elements selected from Fe, Si, Co, and P.

Here, the reasons for defining the component compositions of the casting mold material and the Cu—Cr—Zr alloy material as described above will be described below.

(Cr: 0.3 Mass % to Less than 0.5 Mass %)

Cr is an element having an action effect that improves strength (hardness) and electrical conductivity by finely precipitating Cr-based precipitates in crystal grains of the matrix by means of an aging treatment.

Here, in a case where the amount of Cr is less than 0.3 mass %, the precipitation amount during the aging treatment becomes insufficient, and there is a concern that the strength (hardness) improvement effect cannot be sufficiently obtained. In addition, in a case where the amount of Cr is 0.5 mass % or more, for example, when the casting mold material and the Cu—Cr—Zr alloy material are slowly cooled from a high temperature range of approximately 1,000° C. to a temperature of 800° C. or lower at a cooling rate of 25° C./min or lower, granular Cr-based and Zr-based precipitates are precipitated, these granular precipitates further grow in the aging treatment after the slow cooling, and thus there is a concern that it may become impossible to ensure fine precipitates that contribute to the precipitation strengthening mechanism.

On the basis of what has been described above, in the present embodiment, the amount of Cr is set in a range of 0.3 mass % to less than 0.5 mass %. In order to reliably exhibit the above-described action effect, the amount of Cr is preferably set to 0.35 mass % or more, and the amount of Cr is preferably set to 0.45 mass % or less.

(Zr: 0.01 Mass % to 0.15 Mass %)

Zr is an element having an action effect that improves strength (hardness) and electrical conductivity by finely precipitating Zr-based precipitates at the crystal grain boundaries of the matrix by means of the aging treatment.

Here, in a case where the amount of Zr is less than 0.01 mass %, the precipitation amount during the aging treatment becomes insufficient, and there is a concern that the strength (hardness) improvement effect cannot be sufficiently obtained. In addition, in a case where the amount of Zr exceeds 0.15 mass %, there is a concern that the electrical conductivity and the thermal conductivity may decrease. In addition, even when more than 0.15 mass % of Zr is included, there is a concern that an additional strength improvement effect cannot be obtained.

On the basis of what has been described above, in the present embodiment, the amount of Zr is set in a range of 0.01 mass % to 0.15 mass %. In order to reliably exhibit the above-described action effect, the amount of Zr is preferably set to 0.05 mass % or more, and the amount of Zr is preferably set to 0.13 mass % or less.

(One or More Elements Selected from Fe, Si, Co, and P: a Total of 0.01 Mass % to 0.15 Mass %)

Elements of Fe, Si, Co, and P have an action effect that suppresses granular Cr-based and Zr-based precipitates being precipitated when, for example, the casting mold material and the Cu—Cr—Zr alloy material are slowly cooled from a high temperature range of approximately 1,000° C. to a temperature of 800° C. or lower at a cooling rate of 25° C./min or lower.

Here, in a case where the total amount of one or more elements selected from Fe, Si, Co, and P is less than 0.01 mass %, there is a concern that the above-described action effect cannot be exhibited. On the other hand, in a case where the total amount of one or more elements selected from Fe, Si, Co, and P exceeds 0.15 mass %, there is a concern that the electrical conductivity and the thermal conductivity may decrease.

On the basis of what has been described above, in the present embodiment, the total amount of one or more elements selected from Fe, Si, Co, and P is set in a range of 0.01 mass % to 0.15 mass %. In order to reliably exhibit the above-described action effect, the total amount of one or more elements selected from Fe, Si, Co, and P is preferably set to 0.02 mass % or more, and the total amount of one or more elements selected from Fe, Si, Co, and P is preferably set to 0.1 mass % or less.

(Other Inevitable Impurities: 0.05 Mass % or Less)

Examples of inevitable impurities other than Cr, Zr, P, Fe, Si and Co described above include B, Ag, Sn, Al, Zn, Ti, Ca, Te, Mn, Ni, Sr, Ba, Sc, Y, Ti, Hf, V, Nb, Ta, Mo, W, Re, Ru, Os, Se, Rh, Ir, Pd, Pt, Au, Cd, Ga, In, Li, Ge, As, Sb, Tl, Pb, Be, N, H, Hg, Tc, Na, K, Rb, Cs, Po, Bi, lanthanides, O, S, C, and the like. Since there is a concern that these inevitable impurities may decrease the electrical conductivity and the thermal conductivity, the total amount thereof is preferably set to 0.05 mass % or less.

In addition, the casting mold material of the present embodiment has acicular precipitates or plate-like precipitates containing Cr in the matrix of Cu. The amount of the acicular precipitates or plate-like precipitates containing Cr is not particularly limited, but is preferably 200 to 10,000 precipitates and more preferably 500 to 5,000 precipitates in an arbitrary cross-section having an area of 1 $mm^2$. In addition, the acicular precipitates or plate-like precipitates preferably do not include Zr.

Furthermore, in the casting mold material of the present embodiment, for example, fine Cr-based and Zr-based precipitates having a particle diameter of 1 μm or smaller are dispersed. The amount of these fine Cr-based and Zr-based precipitates is not particularly limited, but is preferably 10 to 50,000 precipitates and more preferably 1,000 to 30,000 precipitates in an arbitrary cross-section having an area of 100 $\mu m^2$. These fine Cr-based and Zr-based precipitates are precipitated in the aging treatment after slow cooling.

The above-described acicular precipitates or plate-like precipitates are formed during slow cooling after a thermal spraying treatment in which a Ni—Cr alloy having excellent thermal resistance or wear resistance is thermal-sprayed when the casting mold material is manufactured. In detail, in the present embodiment, when a copper alloy including 0.3 mass % to less than 0.5 mass % of Cr, 0.01 mass % to 0.15 mass % of Zr, and a balance consisting of Cu and inevitable impurities is, during the thermal spraying treatment, heated to, for example, 1,000° C. or higher and then is slowly cooled from a high temperature range of approximately 1,000° C. to a temperature of 800° C. or lower at a cooling rate of 25° C./min or lower, acicular precipitates or plate-like precipitates containing Cr are precipitated. Therefore, granular Cr-based and Zr-based precipitates (for example, precipitates having a particle diameter of 5 μm or larger) being precipitated during slow cooling are suppressed.

In addition, the Cu—Cr—Zr alloy material of the present embodiment has the same composition as that of the above-described casting mold material, and, in a case where the Cu—Cr—Zr alloy material is maintained at 800° C. after a full solution treatment, the maintenance time taken for the electrical conductivity to reach 55% IACS is set to 25 seconds or longer.

That is, even when the Cu—Cr—Zr alloy material of the present embodiment is maintained at 800° C. after a full solution treatment, the precipitation of the Cr-based and Zr-based precipitates is suppressed, and the amount of the solid solution of Cr and Zr is ensured. The upper limit of the maintenance time taken for the electrical conductivity to reach 55% IACS is not particularly limited, but is preferably set to 360 seconds and more preferably set to 120 seconds.

Furthermore, the Cu—Cr—Zr alloy material of the present embodiment has a relationship of B/A>1.1 in a case where the electrical conductivity (% IACS) after the Cu—Cr—Zr alloy material is maintained at 1,000° C. for one hour and then is cooled from 1,000° C. to 600° C. at a cooling rate of 10° C./min is represented by A, and the electrical conductivity (% IACS) after the Cu—Cr—Zr alloy material is further maintained at 500° C. for three hours is represented by B. Furthermore, the relationship is preferably B/A>1.15 and more preferably B/A>1.2. The upper limit of B/A is not particularly limited, but is preferably set to 2.0 and more preferably set to 1.5.

That is, even in a case where the Cu—Cr—Zr alloy material of the present embodiment is maintained at 1,000° C. for one hour and then is slowly cooled from 1,000° C. to 600° C. at a cooling rate of 10° C./min, the electrical conductivity is improved by a thermal treatment in which the Cu—Cr—Zr alloy material is further maintained at 500° C. for three hours.

Next, a method for manufacturing a casting mold material according to an embodiment of the present invention will be described with reference to the flowchart of FIG. 1.

(Melting and Casting Step S01)

First, a copper raw material made of oxygen-free copper having a copper purity of 99.99 mass % or higher is loaded into a carbon crucible and is melted using a vacuum melting furnace, thereby obtaining molten copper. Next, the above-described additive elements are added to the obtained molten metal so as to obtain a predetermined concentration, and component preparation is carried out, thereby obtaining a molten copper alloy.

Here, as raw materials of Cr and Zr which are the additive elements, Cr and Zr having a high purity are used, for example, as a raw material of Cr, Cr having a purity of 99.99 mass % or higher is used, and, as a raw material of Zr, Zr having a purity of 99.95 mass % or higher is used. In addition, Fe, Si, Co, and P are added thereto as necessary. As raw materials of Cr, Zr, Fe, Si, Co, and P, master alloys with Cu may also be used.

In addition, the component-prepared molten copper alloy is poured into a casting die, thereby obtaining an ingot.

(Homogenization Treatment Step S02)

Next, a thermal treatment is carried out in order for the homogenization of the obtained ingot.

Specifically, a homogenization treatment is carried out on the ingot in the atmosphere under conditions of 950° C. to 1,050° C. for one hour or longer.

(Hot Working Step S03)

Next, hot rolling with a working rate of 50% to 99% is carried out on the ingot in a temperature range of 900° C. to 1,000° C., thereby obtaining a rolled material. The method for the hot working may be hot forging. After this hot working, the rolled material is immediately cooled by means of water cooling.

(Solution Treatment Step S04)

Next, a heating treatment is carried out on the rolled material obtained in the hot working step S03 under conditions of 920° C. to 1,050° C. for 0.5 hours to five hours, thereby carrying out a solution treatment. The heating treatment is carried out, for example, in the atmosphere or an inert gas atmosphere, and as cooling after the heating, water cooling is carried out.

(First Aging Treatment Step S05)

Next, after the solution treatment step S04, a first aging treatment is carried out, and precipitates such as Cr-based precipitates and Zr-based precipitates are finely precipitated, thereby obtaining a first aging treatment material.

Here, the first aging treatment is carried out under conditions of, for example, 400° C. to 530° C. for 0.5 hours to five hours.

The thermal treatment method during the aging treatment is not particularly limited, but the thermal treatment is preferably carried out in an inert gas atmosphere. In addition, the cooling method after the heating treatment is not particularly limited, but water cooling is preferably carried out.

By means of the above-described steps, the Cu—Cr—Zr alloy material that is the present embodiment is manufactured.

(Thermal Spraying Step S06)

Next, after the first aging treatment step S05, a Ni—Cr alloy or the like is thermal-sprayed onto predetermined places on the surface of the Cu—Cr—Zr alloy material, thereby forming coating layers on the predetermined places on the surface of the Cu—Cr—Zr alloy material. In addition, after this thermal spraying, a thermal treatment is carried out on the Cu—Cr—Zr alloy material on which the coating layers are formed at 900° C. to 1,000° C. for 15 minutes to 180 minutes.

This thermal treatment is carried out in order for the diffusion bonding between the Cu—Cr—Zr alloy material and the coating layers.

As cooling after the thermal spraying and then the thermal treatment, slow cooling having a relatively low cooling rate, for example, furnace cooling, is carried out. Here, regarding the cooling rate in the slow cooling, the cooling rate in a range from, for example, the thermal treatment temperature to 800° C. or lower is 5° C./minute to 70° C./minute.

(Second Aging Treatment Step S07)

Next, after the thermal spraying step S06, a second aging treatment is carried out, and precipitates such as Cr-based precipitates and Zr-based precipitates are finely precipitated.

Here, the aging treatment is carried out under conditions of, for example, 400° C. to 530° C. for 0.5 hours to five hours.

The thermal treatment method during the aging treatment is not particularly limited, but the thermal treatment is preferably carried out in an inert gas atmosphere. In addition, the cooling method after the thermal treatment is not particularly limited, but water cooling is preferably carried out.

By means of the above-described steps, the casting mold material of the present embodiment is manufactured.

According to the casting mold material of the present embodiment provided with the above-described constitution, since the casting mold material is provided with a composition including 0.3 mass % to less than 0.5 mass % of Cr, 0.01 mass % to 0.15 mass % of Zr, and a balance consisting of Cu and inevitable impurities, in the second aging treatment step S07, Cr-based and Zr-based precipitates are finely precipitated, whereby it is possible to improve strength (hardness) and electrical conductivity.

In addition, since the casting mold material according to the present embodiment has acicular precipitates or plate-like precipitates containing Cr, granular precipitates being formed during the slow cooling after the thermal spraying treatment step S06 are suppressed, it is possible to sufficiently disperse fine precipitates by means of the second aging treatment step S07 after the thermal spraying treatment step S06, and it is possible to sufficiently improve strength (hardness) by means of the precipitation strengthening mechanism.

In addition, since the casting mold material according to the present embodiment further includes a total of 0.01 mass % to 0.15 mass % of one or more elements selected from Fe, Si, Co, and P, granular precipitates being formed during the slow cooling after the thermal spraying treatment step S06 are suppressed. Therefore, it is possible to sufficiently disperse fine precipitates by means of the second aging treatment step S07 after the thermal spraying treatment step S06, and it is possible to reliably improve strength (hardness) and electrical conductivity.

Furthermore, in a case where the Cu—Cr—Zr alloy material according to the present embodiment is maintained at 800° C. after a full solution treatment, since the maintenance time taken for the electrical conductivity to reach 55% IACS is set to 25 seconds or longer, even in a case where the Cu—Cr—Zr alloy material is heated to a high temperature range of, for example, approximately 1,000° C. in the thermal spraying treatment step S06 and then is slowly cooled, it is possible to ensure the amount of the solid solution of Cr and Zr. Therefore, in the second aging treatment step S07 after the slow cooling, it is possible to disperse Cr-based and Zr-based precipitates, and it is possible to improve strength (hardness) and electrical conductivity. Here, the "full solution treatment" refers to a thermal treatment for causing alloy elements contained in the alloy material to fully form solid solutions in the Cu matrix. In the case of the Cu—Cr—Zr alloy material according to the present embodiment, examples of the thermal treatment include a thermal treatment in which the Cu—Cr—Zr alloy material is maintained at a temperature of 950° C. to 1,050° C. for 0.5 hours to 3.0 hours and is then quenched.

In addition, since the Cu—Cr—Zr alloy material according to the present embodiment has a relationship of B/A>1.1 in a case where the electrical conductivity (% IACS) after the Cu—Cr—Zr alloy material is maintained at 1,000° C. for one hour and then is cooled from 1,000° C. to 600° C. at a cooling rate of 10° C./min is represented by A, and the electrical conductivity (% IACS) after the Cu—Cr—Zr alloy material is further maintained at 500° C. for three hours is represented by B, even in a case where the Cu—Cr—Zr alloy material is heated to a high temperature range of, for example, approximately 1,000° C. and then is slowly cooled in the thermal spraying treatment step S06, in the second aging treatment step S07 after the slow cooling, the electrical conductivity improves, and it is possible to improve strength (hardness) by means of precipitation hardening.

Hitherto, the embodiment of the present invention has been described, but the present invention is not limited thereto and can be appropriately modified in the scope of the technical concept of the invention.

In the present embodiment, the total amount of one or more elements selected from Fe, Si, Co, and P is described to be 0.01 mass % to 0.15 mass %, but is not limited thereto, and these elements may be not be added thereto intentionally.

EXAMPLES

Hereinafter, the results of confirmation tests carried out in order to confirm the effects of the present invention will be described.

A copper raw material made of oxygen-free copper with a purity of 99.99 mass % or higher was prepared, was loaded into a carbon crucible, and was melted using a vacuum melting furnace (with a degree of vacuum of $10^{-2}$ Pa or lower), thereby obtaining molten copper. A variety of additive elements were added to the obtained molten copper so as to prepare a component composition shown in Table 1. After being maintained for five minutes, the molten copper alloy was poured into a casting die made of cast iron, thereby obtaining an ingot. The sizes of the ingot were set to a width of approximately 80 mm, a thickness of approximately 50 mm, and a length of approximately 130 mm.

As a raw material of Cr which was an additive element, Cr with a purity of 99.99 mass % or higher was used, and, as a raw material of Zr, Zr with a purity of 99.95 mass % or higher was used.

Next, a homogenization treatment was carried out in the atmosphere under conditions of 1,000° C. for one hour, and then hot rolling was carried out. The rolling reduction in the hot rolling was set to 80%, thereby obtaining a hot-rolled material having a width of approximately 100 mm, a thickness of approximately 10 mm, and a length of approximately 520 mm.

This hot-rolled material was subjected to a solution treatment under conditions of 1,000° C. for 1.5 hours, and then subjected to water cooling.

Next, a first aging treatment was carried out under conditions of 480 (±15)° C. for three hours, thereby obtaining a Cu—Cr—Zr alloy material.

Next, the obtained Cu—Cr—Zr alloy material was subjected to a thermal treatment under conditions of 1,000° C. for one hour as simulation of a thermal spraying treatment, and then slowly cooled at a cooling rate of 10° C./minute or lower.

After that, a second aging treatment was carried out under conditions of 480 (±15)° C. for three hours, thereby obtaining a casting mold material.

The maintenance time (T. T. T. measurement) taken for the electrical conductivity to reach 55% IACS in a case where the obtained Cu—Cr—Zr alloy material was subjected to a full solution treatment (1,000° C., 1.5 hours) and then was maintained at 800° C., the Vickers hardness (rolled surface), and the electrical conductivity were evaluated.

In addition, the electrical conductivity A (% IACS) after the obtained Cu—Cr—Zr alloy material was maintained at 1,000° C. for one hour and then was cooled from 1,000° C. to 600° C. at a cooling rate of 10° C./min and the electrical conductivity B (% IACS) after the Cu—Cr—Zr alloy material was further maintained at 500° C. for three hours were measured, and the electrical conductivity ratio B/A was evaluated.

Furthermore, for the casting mold material after the thermal spraying treatment and after the second aging treatment, the Vickers hardness (rolled surface) and the electrical conductivity were evaluated. Furthermore, structural observation was carried out, and the presence or absence of acicular precipitates or plate-like precipitates containing Cr was evaluated.

(Composition Analysis)

The component compositions of the obtained Cu—Cr—Zr alloy material and the obtained casting mold material were measured by means of inductively coupled plasma mass spectrometry (ICP-MS). The measurement results are shown in Table 1.

(T. T. T. Measurement)

A test specimen of the Cu—Cr—Zr alloy material that had been subjected to the full solution treatment was maintained at 800° C., the electrical conductivity was measured after a certain period of time elapsed, and the time taken for the electrical conductivity to reach 55% IACS was evaluated. The evaluation results are shown in Table 2.

Figure 2:
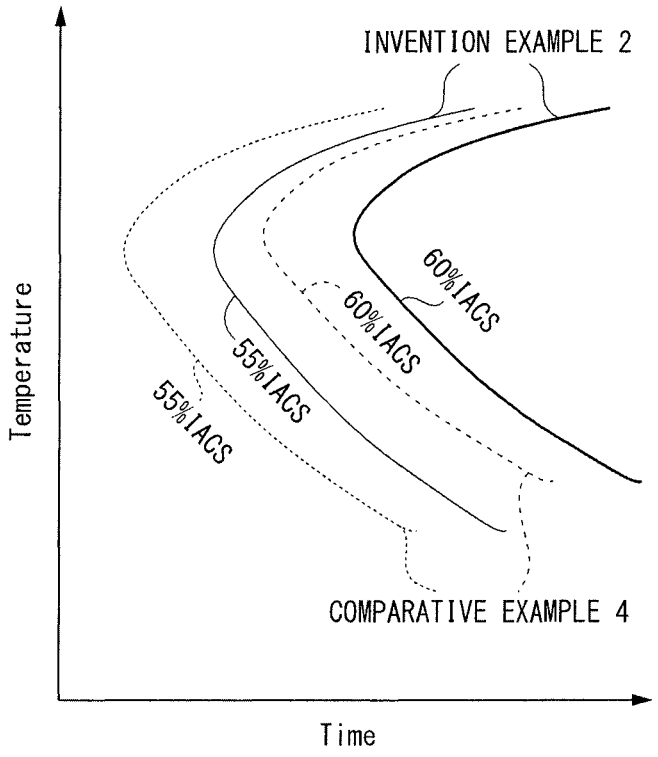
FIG. 2 is an explanatory view showing a T. T. T. curve of a Cu—Cr—Zr alloy material in examples.

In Invention Example 2 and Comparative Example 4, the same evaluation was carried out at temperatures other than 800° C., and the times for the electrical conductivity to reach 55% IACS and 60% IACS at individual temperatures were evaluated, thereby producing T. T. T. curves shown in FIG. 2.

(Structural Observation)

An observation sample was taken from the obtained casting mold material that had been subjected to the thermal spraying treatment, structural observation was carried out using an electron scanning microscope after a polishing treatment, and the presence or absence of acicular precipitates or plate-like precipitates containing Cr was confirmed. The observation results are shown in Table 3. In a case where five or more precipitates with an aspect ratio (the long side/the short side) of 3 or higher were observed in a 50 μm×60 μm observation view, acicular precipitates or plate-like precipitates were determined to be present. In addition, whether or not the observed acicular precipitates or plate-like precipitates contained Cr was determined by means of element mapping.

Figure 3:
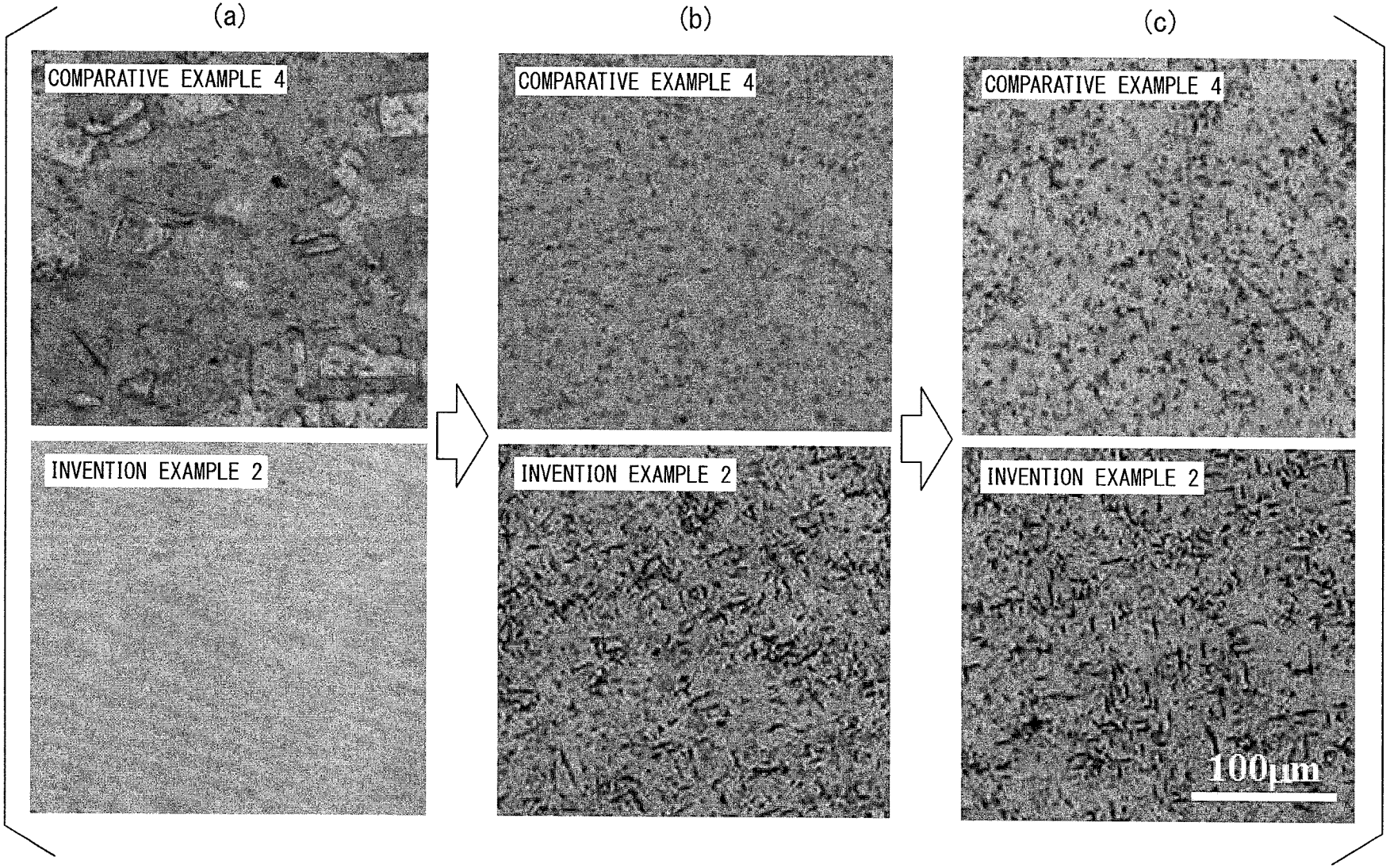
FIG. 3 shows structural observation photographs of Invention Example 2 and Comparative Example 4.
Figure 4:
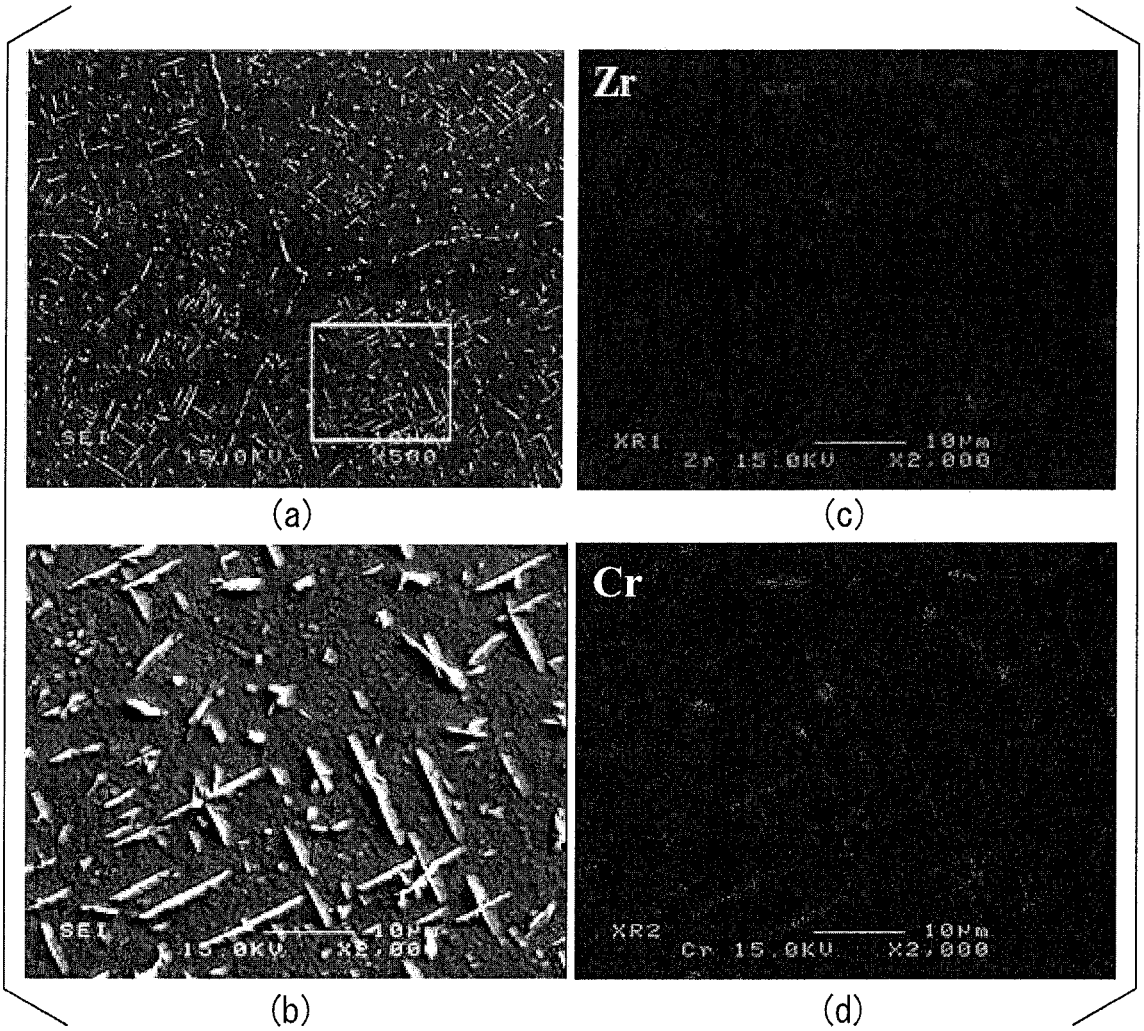
FIG. 4 shows structural observation photographs and element mapping results of acicular precipitates or plate-like precipitates observed in Invention Example 2.

In addition, for Invention Example 2 and Comparative Example 4, the results (structural observation photographs) of the structural observation carried out (a) after the first aging treatment, (b) after the thermal spraying treatment and the slow cooling, and (c) after the second aging treatment are shown in FIG. 3. Furthermore, the observation results of acicular precipitates or plate-like precipitates containing Cr observed in Invention Example 2 after the second aging treatment ((a) a structural observation photograph, (b) an enlarged view of a portion surrounded by a white line in (a), (c) an element mapping result of Zr in (b), and (d) an element mapping result of Cr in (b)) are shown in FIG. 4.

(Vickers Hardness Measurement)

Figure 5:
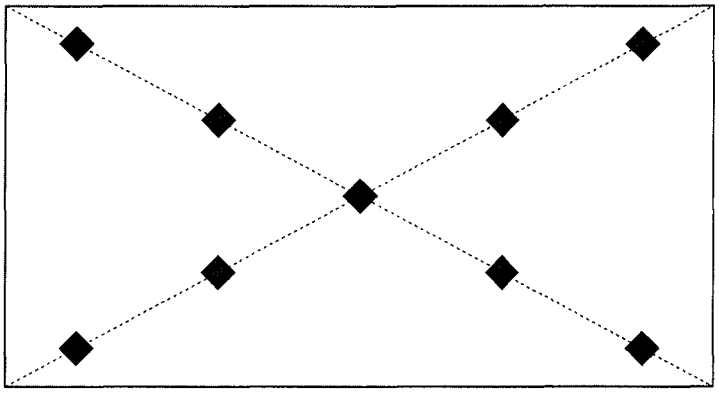
FIG. 5 is an explanatory view showing a Vickers hardness measurement location in the examples.

Vickers hardness was measured at nine places on a test specimen as shown in FIG. 5 using a Vickers hardness tester manufactured by Akashi Co., Ltd. according to JIS Z 2244, and the average value of seven measurement values excluding the maximum value and the minimum value thereof was obtained. The measurement results of the Cu—Cr—Zr alloy material are shown in Table 2, and the measurement results of the casting mold material after the thermal spraying treatment and the second aging treatment are shown in Table 3.

(Electrical Conductivity Measurement)

The electrical conductivity was measured three times using a SIGMA TEST D2.068 (having a probe diameter of ϕ mm) manufactured by FOERSTER JAPAN LIMITED in the central portion of cross-section with 10×15 mm of a sample, and the average value thereof was obtained. The measurement results of the Cu—Cr—Zr alloy material are shown in Table 2, and the measurement results of the casting mold material after the thermal spraying treatment and the second aging treatment are shown in Table 3.

TABLE 1

| | | Composition | | | | | | |
|---|---|---|---|---|---|---|---|---|
| | | Cr | Zr | Fe | Si | Co | P | Cu |
| Invention Example | 1 | 0.35 | 0.13 | — | — | — | — | Balance |
| | 2 | 0.35 | 0.13 | — | 0.02 | — | — | Balance |
| | 3 | 0.40 | 0.07 | — | — | 0.07 | 0.02 | Balance |
| | 4 | 0.48 | 0.10 | 0.04 | — | — | — | Balance |
| | 5 | 0.48 | 0.02 | — | — | — | — | Balance |
| | 6 | 0.49 | 0.15 | 0.10 | — | — | — | Balance |
| | 7 | 0.42 | 0.14 | — | 0.05 | — | — | Balance |
| Comparative Example | 1 | 0.20 | 0.10 | — | — | — | — | Balance |
| | 2 | 0.70 | 0.14 | — | — | — | — | Balance |
| | 3 | 0.70 | 0.02 | — | 0.01 | — | — | Balance |
| | 4 | 0.90 | 0.08 | — | — | 0.14 | 0.04 | Balance |

TABLE 2

| | | Cu-Cr-Zr alloy material | | | |
|---|---|---|---|---|---|
| | | T. T. T. (sec) | Vickers hardness (Hv) | Electrical conductivity (% IACS) | Electrical conductivity ratio B/A |
| Invention Example | 1 | 48 | 135 | 77 | 1.38 |
| | 2 | 50 | 141 | 72 | 1.43 |
| | 3 | 35 | 130 | 80 | 1.31 |
| | 4 | 26 | 135 | 76 | 1.27 |
| | 5 | 27 | 127 | 85 | 1.51 |
| | 6 | 31 | 145 | 71 | 1.19 |

TABLE 2-continued

| | | Cu-Cr-Zr alloy material | | | |
|---|---|---|---|---|---|
| | | T. T. T. (sec) | Vickers hardness (Hv) | Electrical conductivity (% IACS) | Electrical conductivity ratio B/A |
| | 7 | 39 | 144 | 72 | 1.22 |
| Comparative Example | 1 | 60 | 125 | 87 | 1.43 |
| | 2 | 16 | 138 | 70 | 1.03 |
| | 3 | 19 | 131 | 87 | 0.99 |
| | 4 | 15 | 122 | 78 | 1.00 |

TABLE 3

| | | Casting mold | | | | |
|---|---|---|---|---|---|---|
| | | Presence or absence of | After thermal spraying treatment (after slow cooling) | | After second aging treatment | |
| | | acicular or plate-like precipitates | Vickers hardness (Hv) | Electrical conductivity (% IACS) | Vickers hardness (Hv) | Electrical conductivity (% IACS) |
| Invention Example | 1 | Present | 51 | 58 | 91 | 80 |
| | 2 | Present | 56 | 56 | 90 | 80 |
| | 3 | Present | 46 | 59 | 89 | 77 |
| | 4 | Present | 52 | 59 | 93 | 75 |
| | 5 | Present | 50 | 55 | 81 | 83 |
| | 6 | Present | 56 | 59 | 88 | 70 |
| | 7 | Present | 53 | 58 | 91 | 71 |
| Comparative Example | 1 | Absent | 48 | 56 | 70 | 80 |
| | 2 | Absent | 45 | 63 | 49 | 65 |
| | 3 | Absent | 42 | 68 | 51 | 67 |
| | 4 | Absent | 45 | 69 | 66 | 69 |

As shown in Tables 1 and 2, it was confirmed that, in the Cu—Cr—Zr alloy materials of the invention examples, the maintenance times taken for the electrical conductivity to reach 55% IACS in a case where the Cu—Cr—Zr alloy material was subjected to the full solution treatment and then was maintained at 800° C. was 25 seconds or longer. Here, from the T. T. T. curves shown in FIG. 2, it was confirmed that, in Invention Example 2, the times taken for the electrical conductivity to reach 55% IACS and 60% IACS shifted toward the long time side more than in Comparative Example 4 and the precipitation of Cr-based and Zr-based precipitates was suppressed.

In addition, as shown in Table 3, it was confirmed that the casting mold materials of the invention examples had acicular precipitates or plate-like precipitates containing Cr. In addition, it was confirmed that, in the casting mold materials of the invention examples, the Vickers hardness and the electrical conductivity significantly increased more than in the comparative examples due to the second aging thermal treatment.

In addition, as a result of the structural observation, in Comparative Example 4, as shown in FIG. 3, no acicular precipitates or plate-like precipitates containing Cr were observed in the test specimen that had been slowly cooled after the thermal spraying treatment, and granular precipitates were observed.

In contrast, in Invention Example 2, as shown in FIG. 3, acicular precipitates or plate-like precipitates containing Cr were observed in the test specimen that had been slowly cooled after the thermal spraying treatment.

As a result of enlarging and observing precipitates in the test specimen which had been subjected to the second aging thermal treatment in Invention Example 2, Cr was detected from acicular precipitates or plate-like precipitates, and Cr and Zr were detected from granular precipitates as shown in FIG. 4.

INDUSTRIAL APPLICABILITY

According to the casting mold material of the present invention, even in a case where the casting mold material is slowly cooled after a thermal spraying treatment, it is possible to sufficiently improve strength (hardness) and electrical conductivity by means of the subsequent aging treatment. Therefore, the casting mold material of the present invention is preferable for casting of steel materials and the like.

The invention claimed is:

1. A casting mold used for casting a metal material, the casting mold consisting of, as a composition:

0.3 mass % to less than 0.5 mass % of Cr;

0.01 mass % to 0.15 mass % of Zr;

optionally a total of 0.01 mass % to 0.15 mass % of one or more elements selected from Fe, Si, Co, and P; and a balance consisting of Cu and inevitable impurities, wherein the casting mold includes acicular precipitates or plate-like precipitates containing Cr, and an amount of the acicular precipitates or the plate-like precipitates containing Cr is 200 to 10,000 precipitates in an arbitrary cross-section having an area of 1 $mm^2$.

2. A Cu—Cr—Zr alloy material for manufacturing the casting mold according to claim 1, wherein, when the Cu—Cr—Zr alloy material is maintained at 800° C. after a full solution treatment, a maintenance time taken for electrical conductivity to reach 55% IACS is 25 seconds or longer.

3. The Cu—Cr—Zr alloy material according to claim 2, wherein the Cu—Cr—Zr alloy material has a relationship of B/A>1.1, and when electrical conductivity (% IACS) after the Cu—Cr—Zr alloy material is maintained at 1,000° C. for one hour and then is cooled from 1,000° C. to 600° C. at a cooling rate of 10° C./min is represented by A, and electrical conductivity (% IACS) after the Cu—Cr—Zr alloy material is further maintained at 500° C. for three hours is represented by B.

4. The casting mold according to claim 1, further comprising a coating layer formed by thermal spraying on a surface of the casting mold.

5. The casting mold according to claim 1, further comprising a Ni—Cr alloy coating layer formed by thermal spraying on a surface of the casting mold.

* * * * *